United States Patent [19]

Speier et al.

[11] 4,347,199

[45] Aug. 31, 1982

[54] METHOD AND APPARATUS FOR RAPIDLY FREEZING MOLTEN METALS AND METALLOIDS IN PARTICULATE FORM

[75] Inventors: John L. Speier, Midland, Mich.; Thomas M. Gentle, Richmond, Calif.

[73] Assignee: Dow Corning Corporation, Midland, Mich.

[21] Appl. No.: 239,306

[22] Filed: Mar. 2, 1981

[51] Int. Cl.[3] ..... B01J 2/14

[52] U.S. Cl. ..... 264/8; 264/15; 425/8

[58] Field of Search ..... 264/8, 15; 425/8

[56] References Cited

U.S. PATENT DOCUMENTS 2,356,599 8/1944 Landgraf ..... 264/8

2,880,456 4/1959 Kuzela et al. ..... 425/8

3,346,673 10/1967 Last et al. ..... 264/8

4,069,045 1/1978 Lundgren ..... 264/8

*Primary Examiner*—James R. Hall

*Attorney, Agent, or Firm*—Howard W. Hermann

[57] ABSTRACT

Described are a method and apparatus for freezing molten metals and metalloids in particulate or flake form at very rapid cooling rates. A volatile coolant liquid is fed to the center of a rapidly rotating disc-like member to create an outwardly flowing film of coolant across the surface of the member. The material to be processed is fed to the coolant film at a location spaced from the center and is thrown outwardly by centrifugal forces while being cooled by vaporization of the liquid. The rotating member may include upwardly projecting vanes for collision with the outwardly flowing material to produce a higher surface area product.

6 Claims, 3 Drawing Figures

METHOD AND APPARATUS FOR RAPIDLY FREEZING MOLTEN METALS AND METALLOIDS IN PARTICULATE FORM

BACKGROUND OF THE INVENTION

The present invention relates to improvements in forming of particulates of metals and metalloids.

For many applications it is necessary that metals, including metallic alloys, and metalloids such as silicon and its alloys be provided in particulate form. Many systems have been devices for doing this. Among these is the centrifugal atomizer which exists in various forms. In known centrifugal atomizers the material to be atomized is fed onto the surface of a rotating disc-like member which may be dished or flat. In one form of such systems, a gas is used to cool the particles thrown off the rotating member by centrifugal forces. Representative of this type of system are U.S. Pat. Nos. 2,752,196, 4,053,264 and 4,078,873. Other systems rely on contact of molten droplets with a cooled surface.

The prior art systems known to applicants suffer from several disadvantages, especially when the metals or metalloids being processed have a high melting point. One disadvantage when gases are used for cooling is the volume of gas which must pass through the system to provide sufficient cooling capacity for solidification of the particles. Another disadvantage lies in the need for materials of construction of the apparatus which will withstand the temperatures encountered.

Additionally it has been discovered that properties of some alloys are altered by the speed with which the materials are cooled from the molten state. It is known that rapid cooling can be used to make amorphous alloys or metallic glasses. Some of the metallic glasses have been shown to exhibit properties which are quite different from the same materials in the crystalline state. A discussion of these materials is given in an article entitled "Metallic Glasses" by John J. Gilman, appearing in *Science,* volume 208, May 23, 1980 pages 856–861, and in an article of the same title by P. Chaudhari, B. C. Giesser and D. Turnbull appearing in *Scientific American,* Volume 242, (No. 4), April 1980 at pages 98–118.

SUMMARY OF THE INVENTION

It is a primary object of the pesent invention to provide an improved method of production, including rapid cooling, of particles of metals and metalloids. More specifically, a method was sought which was not dependent on exotic materials and was economical to perform.

In accordance with these and other objects there is provided in accordance with the present invention a centrifugal atomizer making use of the heat of vaporization of liquid coolant and which thereby provides a system which offers rapid cooling with the temperature of most components under equilibrium conditions at or near boiling point of the coolant liquid used. The amount of coolant is minimized and there is no need for other than ordinary materials for construction of the mechanical system.

Briefly, the invention comprises rotating a horizontally mounted disc-like member at high speed, introducing a stream of volatile liquid coolant at the center to provide an outwardly flowing film of coolant over substantially the entire upper surface of the rotating member and introducing the material to be atomized into the coolant film at a point spaced from the center.

The molten material and the rotating member are cooled by evaporation of coolant, and particles are thrown from the device by centifugal force. A modification of the rotating member provides upwardly projecting vanes around the periphery of the rotating member which collide with the particles causing them to be flattened and resulting in a high surface area particulate.

BRIEF DESCRIPTION OF DRAWINGS

The invention will become better understood to those skilled in the art from a consideration of the following Description of Preferred Embodiments when read in connection with the accompanying drawings wherein.

DESCRIPTION OF PREFERRED EMBODIMENTS

Figure 1:
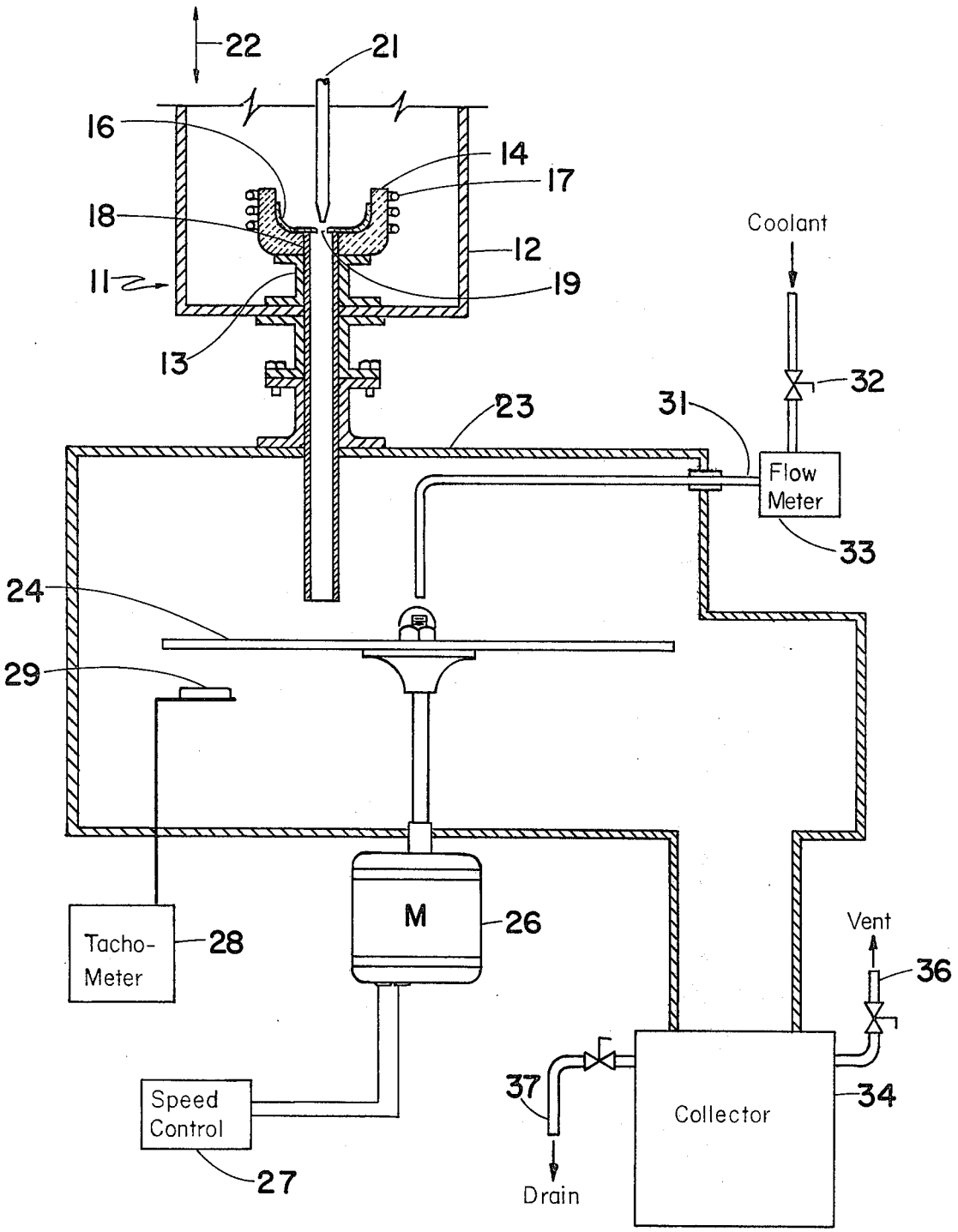
FIG. 1 is a diagrammatic view of a preferred embodiment of the invention.

Referring now to the drawings in FIG. 1 there is shown diagrammatically an apparatus for atomizing metals and metalloids in accordance with the present invention. At the top of the figure there is shown generally by the arrow 11 means for heating the material until it is molten. The means 11 is a closed chamber 12 having mounted on a pedestal 13 a susceptor 14 containing a crucible 16. An induction heating coil 17 energized by a suitable electric power source is utilized to heat the contents of the crucible. The susceptor 14 is preferably made of graphite and the crucible 16 must be chosen to be essentially nonreactive with the material to be melted. In the instance of silicon as the material being processed the crucible is desirably made of quartz, graphite or graphite coated with silicon carbide.

Extending from the bottom of the crucible 16 through the susceptor 14 and pedestal 13 is a tube 18 which in the instance of silicon as the material being processed can also be made of quartz. In the bottom of the crucible 16 and coaxially located with respect to the tube 18 there is provided a tap hole 19 for allowing molten material to flow from the crucible down the tube 18. The flow through the tap hole 19 is controlled by means of a tapered plug 21 which may be raised and lowered as shown by the arrow 22 to plug or open the hole 19 and thereby act as a valve.

Mounted horizontally in a chamber 23 below the heating means 11 is a disc-like member 24 mounted for rotation by suitable means such as a variable speed motor 26 controlled by a speed control unit 27. While the disc-like member shown has a planar upper surface it is to be understood that it may be dished or cup-shaped without departing from the nature of the invention. Desirably, speed is monitored by means of a tachometer 28 having a sensor 29 located to detect rotational speed. If desired, automatic conventional means may be utilized to feed back tachometer signals to the speed controller so that a preset speed can be maintained.

Coaxially mounted with respect to the center of rotation of the disc-like member 24 is the outlet of a liquid coolant supply means comprising a tube 31 and flow control means which desirably include a valve 32 and flowmeter 33. In operation, a volatile liquid coolant, which must be chosen for essential nonreactivity with respect to the material being processed, is supplied by tube 31 to the center of the rotating disc-like member 24 and forms an outwardly flowing coolant film across the upper surface of the rotating member. Molten material to be processed is flowed by means of inlet tube 18 into the coolant film at a point off-center from the center of rotation causing heat to be absorbed by evaporation of the volatile fluid. Centrifugal forces meanwhile act to disperse the work material as it is being cooled and the material is thrown in solidified droplets from the periphery of the disc and collected in a suitable collector 34. To provide for expansion of the evaporating fluid a vent 36 is provided from the collector and a suitable drain 37 may be provided for removal of any excess cooling liquid. If desired, the entire system can be operated in an inert atmosphere and a single chamber can encompass the entire system except for the controls, to permit safe use of combustible or toxic coolants.

When the system is properly controlled the atomized product tends to be made up essentially of round particles. If a greater surface area or flake-like product is desired a modified disc-like member 24A such as that shown in FIGS. 2 and 3 can be employed. The device shown in these Figures has a plurality of vanes 38 positioned around the perihery of the disc-like member and protruding upwardly above its primary surface. In a preferred embodiment each vane is essentially of triangular cross-section having a vertical planar surface 39 positioned radially with respect to the center of rotation of the disc-like member.

In operation of the system with the modified disc-like member 24A the vanes 38 interrupt the outward movement of the material being processed across the upper surface of the rotating member 24A and collide with the material to form foils or flakes as the material moves outwardly and is eventually thrown from the periphery.

The theory of operation of the device can be better understood by realizing that (1) the specific heat of gases is typically 0.26 to 0.4 Calorie per degree Celsius per gram, (2) the specific heat of liquids is typically 0.5 to 1.0 Calorie per degree Celsius per gram, but (3) the heat of vaporization of liquids is about 540 Calories per gram for water, 327 Calories per gram for ammonia, 92 calories per gram for butane and 81 calories per gram for hexane. Thus the evaporation of one gram of the liquids named absorbs up to 1080 times as much heat as a gram of gas and up to 540 times as much heat as any named liquid. When heat is absorbed by evaporation of a liquid the temperature of the system becomes the boiling point of the liquid as long as any liquid remains. Thus, no need exists for high temperature capability for materials of construction of the atomizer. If water is used as coolant temperatures will not substantially exceed 100° C.; with hexane maximum temperature is only about 69° C.

A sample calculation of the relative coolant requirements using gas, liquid, and heat of vaporization of liquid for cooling a 28 gram sample of molten silicon is as follows:

(In these calculations:
$\Delta H_f$=heat of fusion of metal
$C_p$=specific heat
$\Delta T$=temperature change
$\Delta H_v$=heat of vaporization).

To cool 28 grams silicon from 1500° C. to 100° C.:

$\Delta H_f$32 11,100 cal/28 grams $C_p \times \Delta T = 4.95$ cal/°C./28 g×1400° C.=6,930 cal Total calories to be lost from 28 g of Si=18,030 calories.

(A) In a gas atomizer using $N_2$ at 25° C.:

$C_p \times \Delta T = 0.25$ cal/°C./g×75°C.=18.75 cal/gm 18,030 cal/18.75 cal/g=962 g of $N_2$ needed (B) In a liquid non-evaporative system using $H_2O$ at 25° C.:

$C_p \times \Delta T = 1$ cal/°C./g×75° C.=75 cal/gm 18,030 cal/75 cal/g=240 g of $H_2O$ needed (C) In the evaporative system of this invention using $H_2O$ at 25° C.:

$\Delta H_v$=540 cal/°C./g
$C_p$=1 cal/°C./g
540 cal/g×Xg+1 cal/°C./g×75° C.×Xg=18,030 cal
Xg=29.3 g of water needed The invention will be better understood and variations thereof will become apparent to those skilled in the art from a consideration of the following examples of embodiments of the invention.

EXAMPLE 1

A fine-toothed 6-inch diameter circular saw blade was used as the disc-like atomizing member. The saw blade was mounted on a ⅝ diameter shaft driven by a 1.5 horsepower Stanley router motor rated at 22,000 r.p.m. The motor speed was controlled by use of a variable transformer. The molten alloy was dropped through a quartz tube mounted about 1 inch off center of the saw blade. The entire unit except for controls was enclosed in a 3/16 inch steel chamber having a viewing window and gas tight access door. The system was purged with argon. The alloy used as work material was metallurgical grade silicon having added thereto (by weight) 4% copper, 0.5% aluminum and 0.003% tin. Deionized water was used as the coolant liquid. Runs were made at (A) 9,000 r.p.m. and (B) at 15,000 r.p.m. The finished product in both runs was particulate, mostly in the form of smooth spheres and having the following distribution:

| U.S. Standard Mesh Size | (A) 9000 r.p.m. % by wt. | (B) 15,000 r.p.m. % by wt. |
|---|---|---|
| >6 | 10.8 | 5.3 |
| 6–10 | 18.6 | 17.0 |
| 10–16 | 22.0 | 23.4 |
| 16–20 | 13.8 | 14.2 |
| 20–30 | 9.1 | 9.4 |
| 30–60 | 16.3 | 18.3 |
| 60–100 | 5.3 | 6.0 |
| 100–200 | 3.2 | 4.7 |
| 200–325 | 0.9 | 1.3 |
| <325 | nil | 0.3 |

EXAMPLE 2

Figure 2:
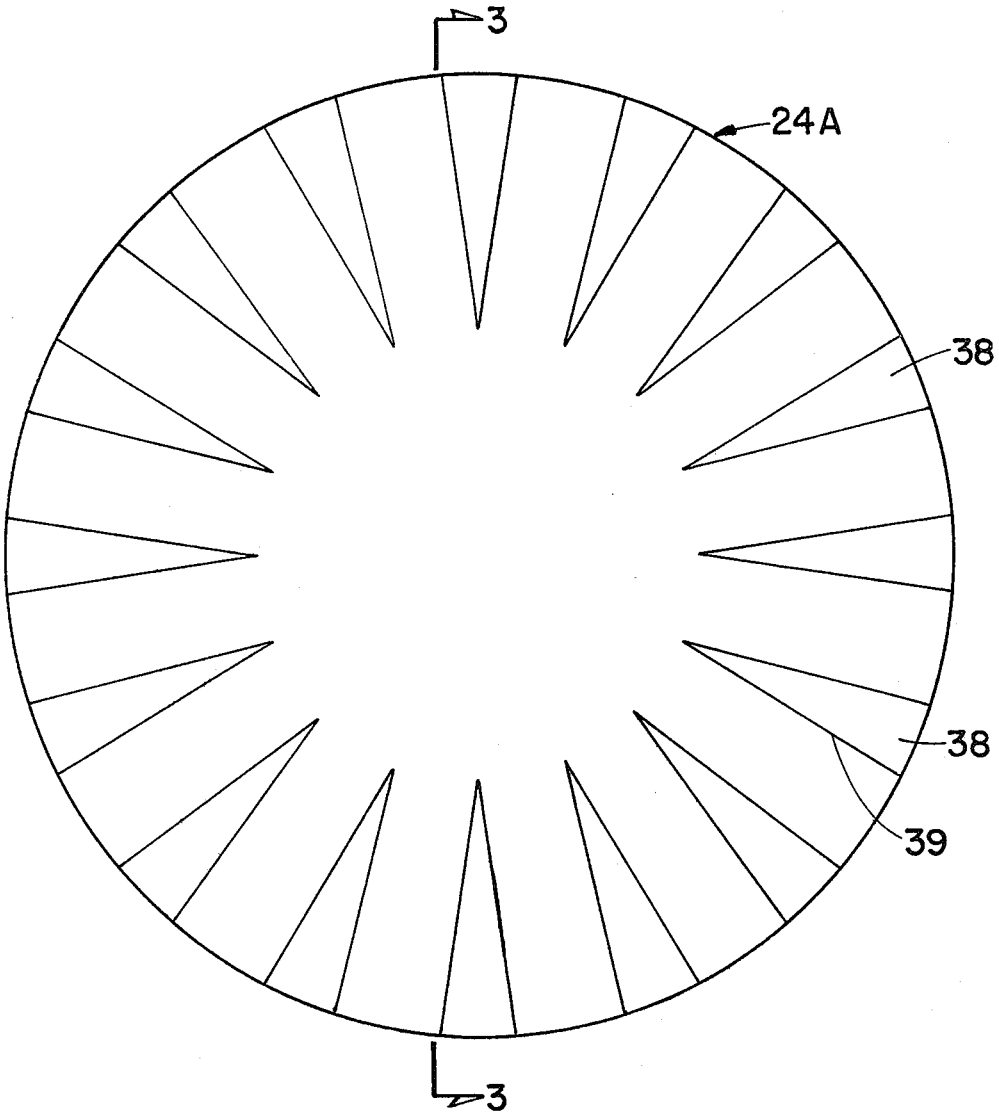
FIG. 2 is a top plan view of a modified embodiment of the rotatable disc-like member included in FIG. 1.
Figure 3:
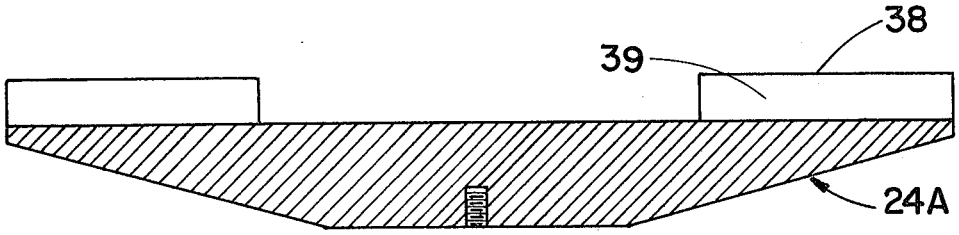
FIG. 3 is a cross-sectional view of the embodiment of FIG. 3 taken on the line 3—3 of FIG. 2.

In the system described in Example 1 there was substituted for the saw blade a vaned disc-like member of the type shown in FIGS. 2 and 3. The vaned device was 8 inches in diameter with 16 vanes each ½ inch high and 2 inches long with the inside edge faced with tool steel to resist abrasion. Samples (percentages by weight) were run as follows:

(C) 7000 r.p.m. metallurgical grade silicon, 2% Cu, 0.003% Sn, cooled with hexane (D) 9000 r.p.m. metallurgical grade silicon, 4% Cu, 0.5% Al, 0.003% Sn, cooled with deionized $H_2O$ (E) 10,000 r.p.m. metallurgical grade silicon, cooled with deionized $H_2O$ (F) 10,000 r.p.m. 70% Cu, 30% Titanium, cooled with deionized $H_2O$.

(G) 10,000 r.p.m. 92% Al, 8% Cu, cooled with hexane (H) 8,500 r.p.m. 90% Sn, 10% Cu, cooled with deionized $H_2O$ (I) 5000 r.p.m. 81% Fe, 19% Boron, cooled with deionized $H_2O$ The finished product in all runs was particulate, being irregular with sharp edges and irregular surfaces, usually with one dimension much smaller than the others indicating likely breakup of flakes.

Particle size distributions were as follows:

| U.S. Standard | Percent by Weight | | | | | |
|---|---|---|---|---|---|---|
| Mesh | C | D | E | F | G | H |
| 60–100 | 39.4 | 25.6 | 10.8 | 44.3 | 16.0 | 12.5 |
| 100–200 | 24.6 | 30.4 | 20.5 | 20.4 | 26.0 | 17.2 |
| 200–325 | 25.6 | 19.5 | 23.9 | 18.4 | 25.4 | 13.3 |
| <325 | 0.4 | 24.5 | 45.5 | 16.8 | 31.8 | 57.0 |

The product of Sample I consisted of large flakes averaging about 15 mm long, 10 mm wide and 0.1–0.2 mm thick. The surface was not smooth and thickness not uniform. The largest flakes were as long as about 30 mm. Some flakes adhered to the vanes.

That which is claimed is:

1. A method for rapid freezing of metals and metalloids in particulate form from a melt of such materials, the method comprising:

rotating a substantially horizontally mounted disc-like member at high speed, introducing a stream of volatile liquid coolant at the center of rotation of said disc-like member in sufficient quantity to provide an outwardly flowing film of coolant liquid over substantially the entire upper surface of the disc-like member, and introducing molten material into the film of liquid coolant on the rotating disc-like member at a distance spaced from the center of rotaion of the member, whereby said molten material is cooled to the solid state by vaporization of the liquid coolant and dispersed by centrifugal forces acting upon the coolant and material.

2. Particulate material made by a process as defined in claim 1.

3. Apparatus for rapid freezing of metals and metalloids in particulate form from a melt of such materials, the apparatus comprising:

a disc-like member mounted substantially horizontally on a centrally located shaft connected to a high rotatable speed power source, means for introducing a flow of volatile liquid coolant to the center of rotation of the disc-like member in sufficient quantity to create an outwardly flowing film of coolant liquid over substantially the entire upper surface of the disc-like member as it is rotated, and means for introducing the molten material into the film of liquid coolant on the rotating disc-like member at a distance spaced from the center of rotation of the member, whereby the molten material is cooled to the solid state by vaporization of the liquid coolant and dispersed by centrifugal forces acting upon the coolant and material.

4. Apparatus as defined in claim 3 wherein the disc-like member has a smooth upper surface.

5. Apparatus as defined in claim 3 wherein the disc-like member has around its peripheral portion a plurality of vanes protruding above its primary upper surface whereby the outwardly flowing material collides with the vanes thereby producing a flattened particulate product.

6. Apparatus as defined in claim 5 wherein one surface of each of said vanes is substantially a vertical planar surface positioned radially with respect to the center of rotation of the disc-like member.

* * * * *